US005100293A

United States Patent [19]

Anzai et al.

[11] Patent Number: 5,100,293

[45] Date of Patent: Mar. 31, 1992

[54] TURBINE BLADE

[75] Inventors: Shunichi Anzai, Hitachi; Kazuhiko Kawaike, Katsuta; Takashi Ikeguchi, Hitachi; Masami Noda, Hitachi; Tetsuo Sasada, Hitachi; Isao Takehara, Hitachi; Haruo Urushidani, Hitachi, all of Japan

[73] Assignee: Hitachi, Ltd., Tokyo, Japan

[21] Appl. No.: 573,798

[22] Filed: Aug. 28, 1990

[30] Foreign Application Priority Data

Sep. 4, 1989 [JP] Japan ..... 1-227386

[51] Int. Cl.[5] ..... F01D 5/18

[52] U.S. Cl. ..... 416/96 A

[58] Field of Search ..... 416/96 A, 97 R; 415/115, 116

[56] References Cited

U.S. PATENT DOCUMENTS

| | | | |
|---|---|---|---|
| 3,301,526 | 1/1967 | Chamberlain | 416/97 R |
| 3,809,494 | 5/1974 | Redman | 416/97 R |
| 3,930,748 | 1/1976 | Redman | 416/96 A |
| 4,021,139 | 5/1977 | Franklin | 416/97 R |
| 4,183,716 | 1/1980 | Takahara | 416/96 A |
| 4,565,490 | 1/1986 | Rice | 416/97 R |
| 4,697,985 | 10/1987 | Suzuki | 415/115 |

FOREIGN PATENT DOCUMENTS

| | | | |
|---|---|---|---|
| 49102 | 3/1986 | Japan | 416/97 R |
| 565991 | 7/1977 | U.S.S.R. | 416/96 A |

*Primary Examiner*—John T. Kwon

*Attorney, Agent, or Firm*—Antonelli, Terry, Stout & Kraus

[57] ABSTRACT

A cooling structure for a turbine blade. Comprising a hollow-structured main body and a cooling medium discharging device located in the inner cavity of the hollow-structured main body and formed to discharge a cooling medium from the surface thereof, so that the cooling medium discharged from the cooling medium discharging device impinges against the inner surface of the main body to remove the heat from the same. The turbine blade further includes a projection formed on the inner surface of the leading edge of the main body, extending along the spanwise direction of the blade, and the cooling medium discharging device is formed to allow at least part of the cooling medium to directly impinge against proximal portions of the projection. With this arrangement, a turbine blade is provided which allows a small amount of cooling air to cool the turbine blade and its leading edge in particular with great effectiveness.

13 Claims, 5 Drawing Sheets

TURBINE BLADE

BACKGROUND OF THE INVENTION

1. Industrial Field of the Invention

The present invention relates to an improvement of a turbine blade in a gas turbine and, more particularly, to a cooling structure of the turbine blade.

2. Description of the Relative Art

By burning fuel with an oxidizing agent of high-pressure air which has been compressed by a compressor, a gas turbine serves to drive a turbine by high-temperature high-pressure gas thus produced, in order to convert the generated heat into energy such as electricity. As a method for improving the performance of a gas turbine, working gas has been changed to have higher temperature and higher pressure. When the temperature of the working gas is elevated, it is necessary to cool a turbine blade and maintain its temperature not to exceed a practical temperature of material of the turbine blade. An example of a conventional cooling structure of a turbine blade is disclosed in ASME, 84-GT-114, Cascade Heat Transfer Tests of The Air Cooled W501D First Stage Vane (1984), FIG. 2.

In this cooling structure of the turbine blade, the blade is of a double structure, i.e., the blade body has a hollow-structured body provided with an inner constituent member (hereinafter referred to as the core plug) therewithin. A large number of apertures are bored through the core plug so that compressed air extracted from a compressor is discharged from these apertures (hereinafter referred to as the impingement holes) against the inner surface of the blade body, thus performing impingement cooling by strong impingement air jets. The air which has cooled the turbine blade from the inside is discharged from the suction and pressure sides or the trailing edge of the blade into main working gas. The number of the impingement holes at each location is appropriately chosen in accordance with fluid heat transfer conditions of the main working gas, thereby allowing the whole blade to have a substantially uniform temperature. The exterior surface of the blade in the vicinity of the leading edge is exposed to the gas of high temperature, which has a particularly high heat transfer rate there. This leading edge portion has a curvature which is unfavorably large for cooling, and accordingly, the cooled area of the inner surface of this portion is relatively small in comparison with the heated area of the outer surface of the same. Therefore, a great number of impingement holes are located inside of the leading edge portion so as to cool it with a large amount of cooling air. This tendency has been especially strengthened in response to the recent elevation of the gas temperature.

Another example of a conventional cooling structure of a turbine blade in a high-temperature gas turbine is disclosed in ASME, 85-GT-120, Development of a Design Model for Airfoil Leading Edge Film Cooling (1985), FIG. 1. In this cooling structure, the blade is of a double structure equivalent to the above-described conventional example, where impingement cooling is conducted by discharging cooling air from impingement holes of a core plug within the blade, and also, film cooling is performed by releasing part of the cooling air into main working gas from a large number of apertures (hereinafter referred to as the film cooling holes) formed at a portion in the vicinity of a leading edge portion of the blade.

SUMMARY OF THE INVENTION

As mentioned previously, because extracted air from the compressor is used for cooling the turbine blade, an increase of an amount of the cooling air induces decrease of thermal efficiency of the gas turbine as a whole. As it is an essential factor of cooling of the gas turbine to carry out the cooling operation effectively by a small amount of air, the conventional method for cooling the turbine blade described above has a problem in that the thermal efficiency of the gas turbine cannot be much improved even by the higher temperature of the gas, for the amount of cooling air is increased to deal with the problem of the elevation of the gas temperature.

The second example of the conventional method has a larger cooling effect than the first example. However, it is not very different from the first example in that a large amount of cooling air is required.

Moreover, when the inner surface of the blade body is cooled by the cooling air discharged from the impingement holes, the cooling air discharged against the inner surface of the leading edge portion of the blade tends to stagnate in its vicinity, and air which flows across the impingement air has an unfavorable influence of lessening the heat transfer rate of the impingement air. Therefore, the conventional methods have the problem that the leading edge of the blade, which has the highest temperature and must be cooled most effectively, cannot be adequately cooled.

The present invention, which is intended to solve the problem, has an object to provide a turbine blade which enables a small amount of cooling air to cool the blade and its leading edge in particular with great effectiveness.

The object of the present invention can be achieved by forming a projection, which extends along the spanwise direction of a blade, on the inner surface of the leading edge of a main body of the blade, so that when a cooling medium is discharged from impingement holes, at least part of the cooling medium will, impinge against proximal portions of the projection.

With this arrangement, the discharged cooling medium does not stagnate in the vicinity of the inner surface of the leading edge of the blade which has the highest temperature and must be cooled most effectively, i.e., the cooling medium discharged from plural rows of impingement holes is separated by the projection, and consequently, jets of the discharged cooling medium do not interfere with one another, thereby enabling a small amount of the cooling medium to effectively cool the leading edge of the blade which tends to have high temperature. Moreover the projection itself has the effect of fin due to the enlarged cooled surface area.

DETAILED DESCRIPTION OF THE PREFERRED EMBODIMENTS

Figure 1:
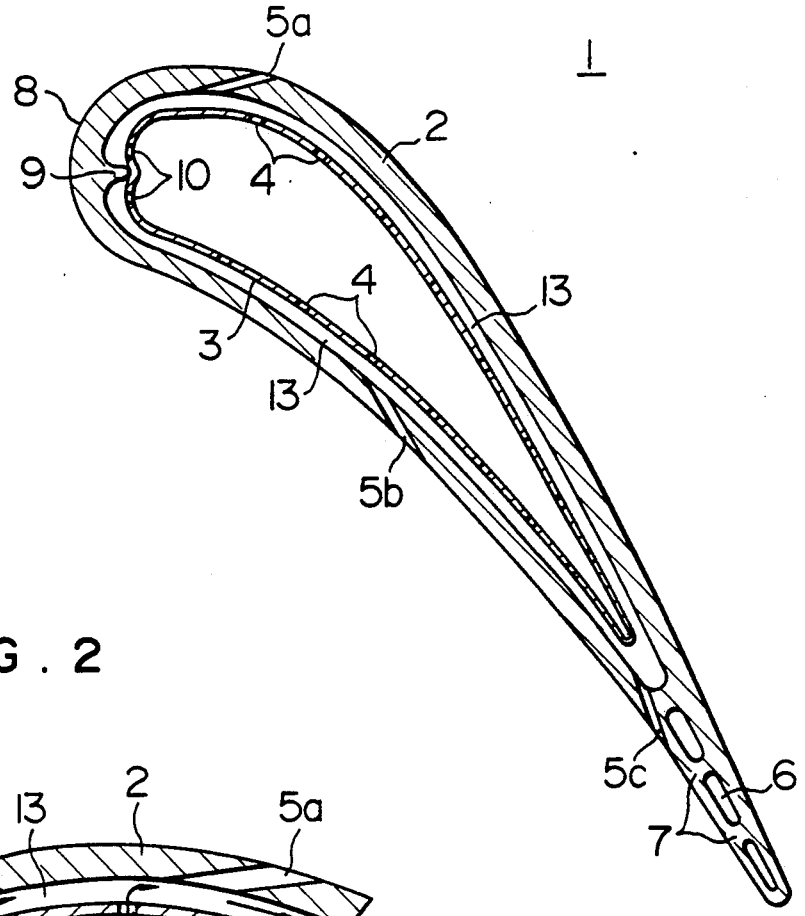
FIG. 1 is a cross-sectional view of a gas turbine blade, showing one embodiment according to the present invention.

As shown in FIG. 1, a turbine blade; includes a hollow main body 2, with a hollow core plug (cooling medium discharging means) being provided within the main body of the blade, and cooling air discharge impingement holes 4 bored through the core plug 3. Film cooling holes 5*a*, 5*b* and 5*c* for extending cooling air are bored through the main body 2, and an air ejection slit 6. including heat transfer pins 7 which is formed through the trailing edge of the blade. A spanwise finlike projection or pier 9 is formed on the inner surface of the turbine blade in the vicinity of its leading edge 8 while extending along the spanwise direction of the blade, and impingement holes 10 are formed through a leading edge portion of the core plug 3 and are located at positions corresponding to both sides of the spanwise finlike projection 9, which will be described in detail later.

Figure 2:
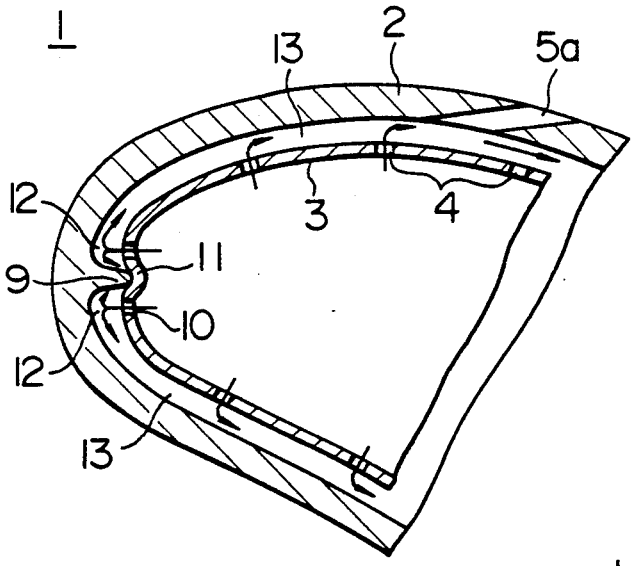
FIG. 2 is an enlarged view of a leading edge portion of the turbine blade shown in FIG. 1.
Figure 3:
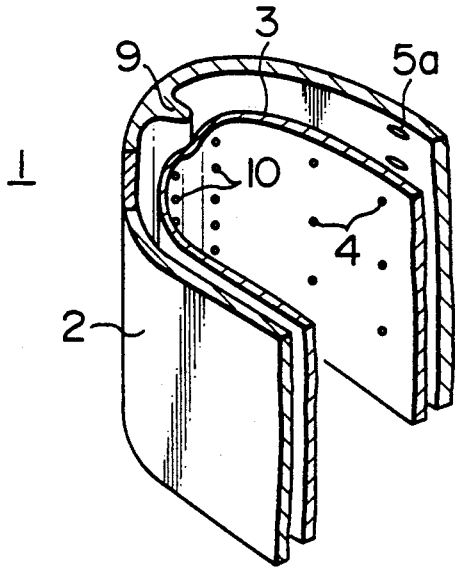
FIG. 3 is a broken-away perspective view of the leading edge portion shown in FIG. 2.

As clearly shown in FIGS. 2 and 3 it is important that a plurality of impingement holes 10 are bored through the core plug 3 at the positions along the spanwise direction of the blade so that jets of cooling air discharged from these impingement holes (hereinafter referred to as the impingement air) will impinge against proximal portions of the spanwise finlike projection 9. A groove 11, formed in the outer surface of the leading edge portion of the core plug 3, is in close contact with the edge of the spanwise finlike projection 9 in order to position the core plug 3 with respect to the blade body 2.

A portion of compressed air is extracted from a compressor (not shown) serving as cooling medium supplying means, and supplied as cooling air into the core plug 3 of the turbine blade 1. This cooling air is discharged as high-speed impingement air jets 12 from the impingement holes 10 of the core plug 3 toward the proximal portions of the spanwise finlike projection 9 formed inside of the leading edge of the blade body 2. The impingement air along with air which has been likewise discharged from the other impingement holes 4 passes through passages 13 between the blade body 2 and the core plug 3 toward the downstream side of the blade, and it is discharged from the film cooling holes 5*a* , 5*b* and 5*c* so as to flow along the outer surface of the blade body 2 into main working gas or ejected through the air ejection slits 6 of trailing edge of the blade.

According to the present invention, the leading edge portion of the blade, which is severely affected by the heat of the working gas, i.e., which is of the highest temperature, can be cooled with an improved effect because the cooling air jets 12 from the impingement holes 10 can be prevented from interfering with one another by the spanwise finlike projection 9. The cooling effect can be enhanced by performing the cooling operation by the impingement air jets. The spanwise finlike projection 9 also serves as a heat transfer fin to further improve the cooling effect. Thus, the present invention enables a small amount of cooling air to effectively cool the portion of the turbine blade where the temperature is the highest, and consequently, the thermal efficiency of the gas turbine as a whole can be increased.

Figure 4A:
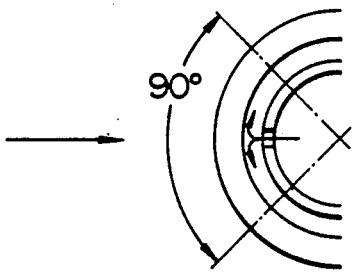
FIG. 4A, 4B and 4C illustrate relations between surface temperatures of blades and impingement holes.
Figure 4B:
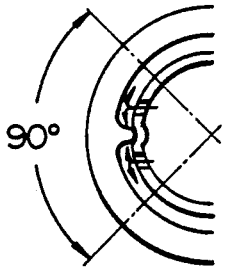
Figure 4C:
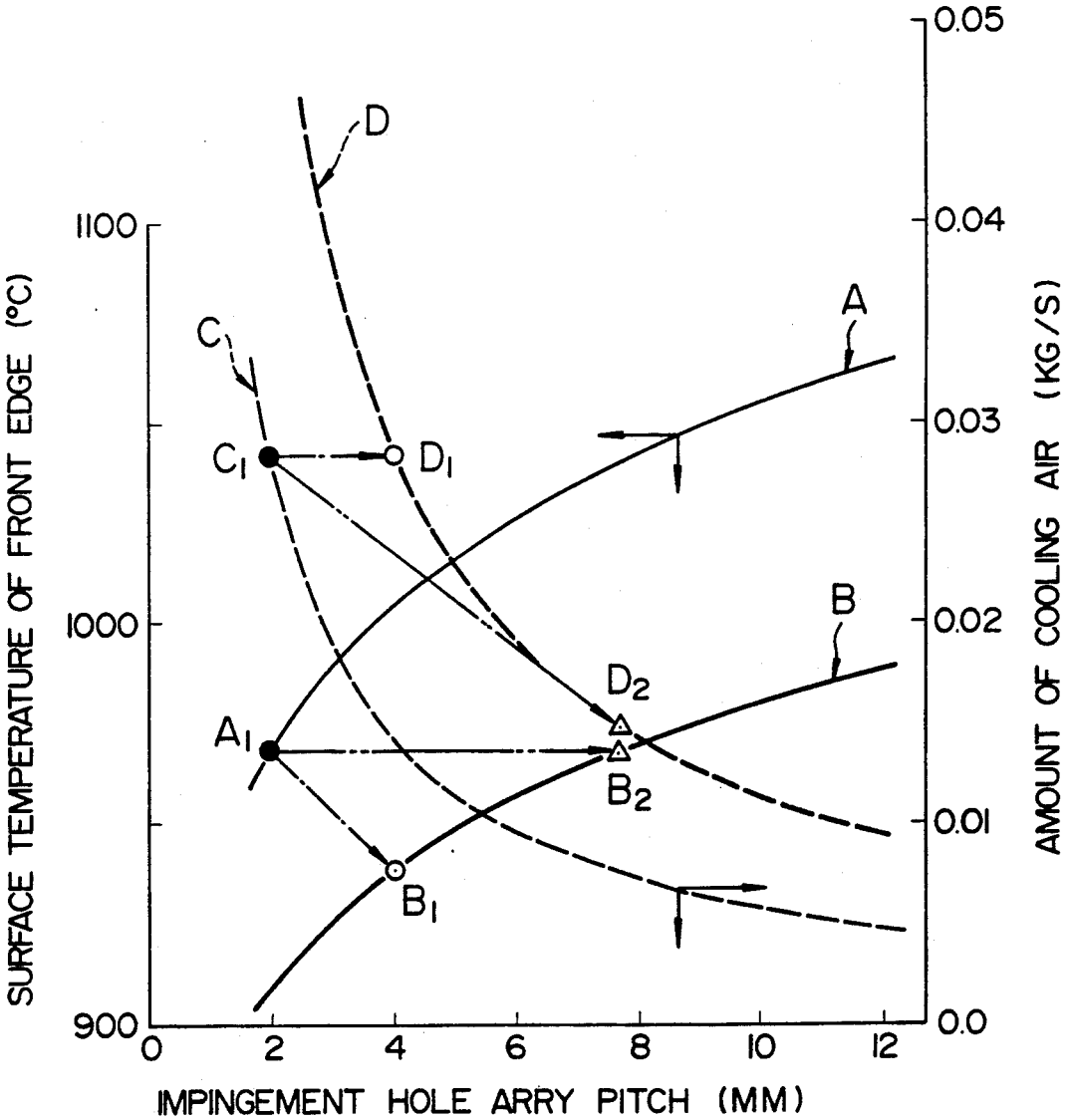

The cooling effect according to the present invention was confirmed by calculations, with the results being shown in FIG. 4C. FIGS. 4A and 4B illustrate structures for comparing a conventional example and the embodiment according to the present invention. The calculations were conducted under the conditions of main working gas; a pressure of 14 ata; a temperature of 1580° C.; and a flow velocity of 104 m/s, and those of cooling air: a pressure of 14.5 ata; a temperature of 400° C.; and an impingement air flow velocity of 110 m/s. The configuration of the leading edge portion of each blade was assumed to be an arc of 25 mm in diameter with the blade length being 120 mm. The main body of the blade have a thickness of 3 mm; the core plug and the blade body had a gap of 2.5 mm; and each impingement hole had a diameter of 1 mm. It was also assumed that the spanwise finlike projection was shaped to be 1.63 mm wide and 2.5 mm high, and that the blade body had a heat conductivity of 20 kcal/mh° C. It was further assumed that the leading edge portion of the blade occupied an extent of 90 degrees with respect to the leading edge arc, and that the pitch between two rows of the impingement holes serving to cool this leading edge portion had different values. Thus, the amount of the cooling air and the temperature of the blade were calculated to compare the results of the embodiment according to the present invention with those of the conventional example.

The heat transfer rate of the surface of the turbine blade, i.e., of the working gas was given by the empirical formula (1) of Schmidt et al., and the heat transfer rate of the impingement cooling medium was given by the empirical formula (2) of Metzger et al., so that the calculations were conducted through calculus of finite differences.$_{Pr}$ $$Nu_d = 1.14\, Re_d^{0.5}\, Pr^{0.4}\left[1 - \left[\frac{\phi}{90}\right]^3\right] \quad (1)$$

where $Nu_1$: Nusselt number ($=\alpha.d/\lambda$)

$Re_d$: Reynolds number ($=v.d/\nu$)

Pr: Prandtl number $\phi$: an arcuate angle of the leading edge portion $\alpha$: a heat transfer rate $\lambda$: a heat conductivity $\nu$: a kinematic viscosity d : a diameter of the leading edge portion v : a flow velocity of the main gas $$St = 0.355\, Re_b - 0.27(l/b) - 0.52 \quad (2)$$

where

St: Stanton number ($=\alpha/\rho.C_p.V_c$)

$Re_b$: Reynolds number ($=2.V_c.b/\nu$)

l: a half distance of heat transfer b: an equivalent slit width of the impingement hole d: a diameter of the impingement hole $C_p$: a specific heat
$V_c$: a flow velocity of the impingement air
p: a density
$\nu$: a kinematic viscosity On the basis of results of the above-described calculations, FIG. 4C explains the surface temperature and the amount of the cooling air at a stagnation point of the leading edge of each blade, with the abscissa representing the impingement hole array pitch. In this graph, a curved line A expresses the blade temperature of the conventional example, and a curved line B expresses that of the embodiment according to the present invention. A curved line C represents the amount of the cooling air per blade at the leading edge of the blade in the conventional example, and a curved line D represents that according to the invention. The effect of the present invention can be obviously understood from this graph. For instance, when the impingement hole array pitch of the conventional example was assumed to be 2 mm, the amount of the cooling air had a value indicated with a point $C_1$ (0.0285 kg/S), and the blade temperature had a value indicated with a point $A_1$ (969° C.). On the other hand, with the same amount of the cooling air (as indicated with a point $D_1$ on the curved line D), when the impingement hole array pitch of the present invention was assumed to be 4 mm, the blade temperature could be reduced to a value indicated with a point $B_1$ (938° C.). Further, when the blade temperature was supposed to be the same as that of the conventional example, i.e., when it was allowed to reach 969° C. (a point $B_2$), the impingement hole array pitch of the invention had a value of 7.8 mm, and then, the amount of the cooling air had a value indicated with a point $D_2$ (0.0138 kg/S). That is to say, according to the present invention, the blade temperature can be about 31° C. lower than that of the conventional example with the same amount of the cooling air. When the blade temperature is allowed to be the same as that of the conventional example, about half of the cooling air amount of the conventional example will be sufficient in this invention. The mutual relationship of the blade temperature and the amount of the cooling air does not vary with a different array pitch.

As described so far, the present invention enables a small amount of the cooling air in comparison with the conventional example to effectively perform the cooling operation. Also, as shown in FIG. 2, the spanwise finlike projection 9 is arranged to support the core plug 3 so as to maintain a given distance of the gap between the cooled surface of the blade body 2 and the core plug 3 and a certain relationship between the positions of the impingement holes and those of impingements of the air. Thus, it is possible to obtain a gas turbine blade of high reliability which causes little individual variation in its cooling effect.

In general, the temperature of working gas for a gas turbine exhibits such a distribution that a central portion of a turbine blade with respect to its spanwise direction has high temperature. In the present invention, the array pitch of the impingement holes 10 with respect to the spanwise direction of the blade may be changed, i.e., the array pitch in the vicinity of the center of the blade may be decreased so as to allow the whole blade to have a uniform temperature.

In the above-described embodiment, the cooling air discharged from the impingement holes 10 and 4 is ejected from the film cooling holes 5*a* , 5*b* and 5*c* so as to flow along the surface of the blade body 2. Positioning and array of these film cooling holes 5*a* , 5*b* and 5*c* and the impingement holes 4, which are determined under the thermal condition of the working gas, can be arranged with variation. In the embodiment shown in FIG. 1, the blade body 2 is hollow-structured without inner partitions. However, it may be of a hollow structure divided into two cells or more. Further, the blade body may be structured without film cooling arrangement so that all the impingement air will be released from the trailing edge or the tip side of the blade. Besides, the spanwise finlike projection of the blade body may be manufactured in the process of production of the blade body through precision casting.

Although the present invention has been described on the basis of one embodiment above, other embodiments, applications and modifications of various kinds can be suggested.

Figure 5:
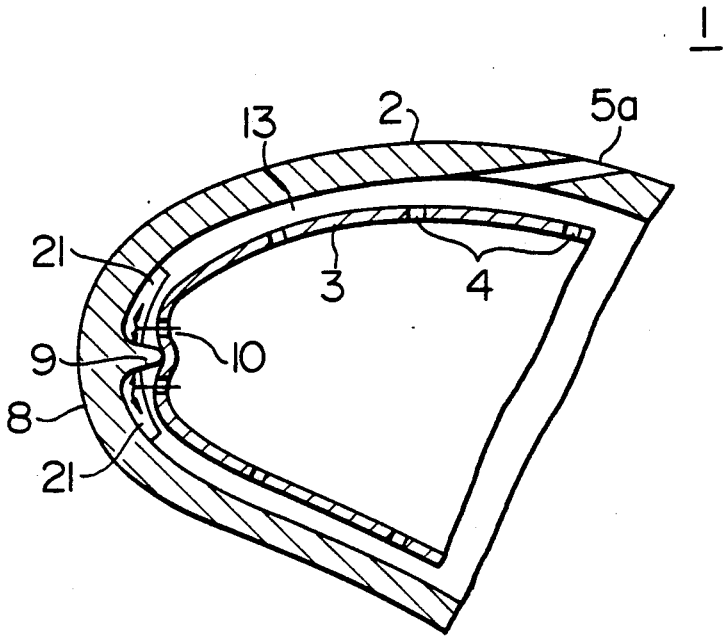
FIG. 5 is an enlarged cross-sectional view of a leading edge portion of a turbine blade, showing another embodiment according to the present invention.
Figure 6:
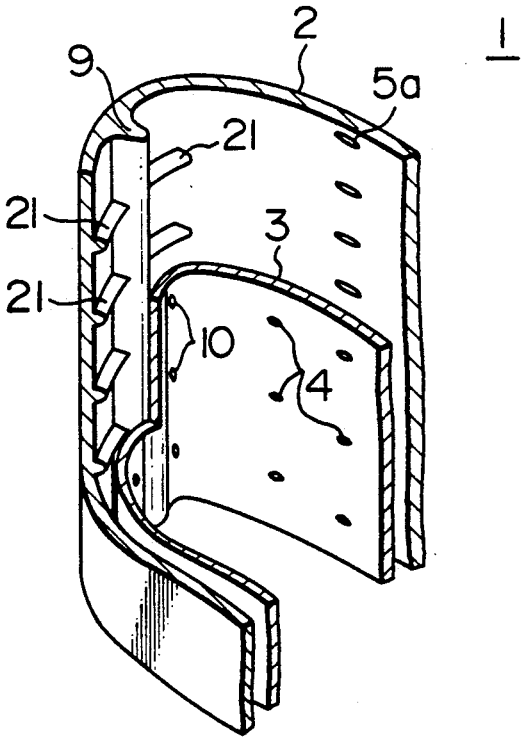
FIG. 6 is a broken-away perspective view of the leading edge portion shown in FIG. 5.

Another embodiment according to the invention is shown in FIGS. 5 and 6. In these figures, the same component parts as those of the embodiment described previously are denoted by the same reference numerals. A plurality of lateral finlike projections 21 are formed on both sides of the spanwise finlike projection 9 on the inner surface of the blade body 2 in the vicinity of the leading-edge stagnation point. One end of each lateral finlike projection 21 is connected with the spanwise finlike projection 9 so that the spanwise finlike projection 9 and the lateral finlike projections 21 will constitute a tandem (fishbone-shaped) configuration. The leading-edge impingement holes 10 of the core plug 3 are located at such positions that impingement cooling air will be discharged into U-shaped heat transfer elements defined by the spanwise finlike projection 9 and the lateral finlike projections 21 and against the proximal portions of the spanwise finlike projection 9.

In the same manner as the above-described embodiment, the cooling air is supplied into the core plug 3, discharged from the impingement holes 10 and 4 toward the cooled surface of the blade, and ejected from the film cooling holes 5*a* and the like into the main working gas after passing through the passages 13. Thus, the air jets discharged from the impingement holes 10 at the leading edge of the blade against the proximal portions of the spanwise finlike projection 9 of the blade body 2 can be prevented from interfering with one another by the spanwise finlike projection 9 and the lateral finlike projections 21. Consequently, a high impingement effect can be obtained, and also, function of the fins further increases the cooling effect.

Figure 7:
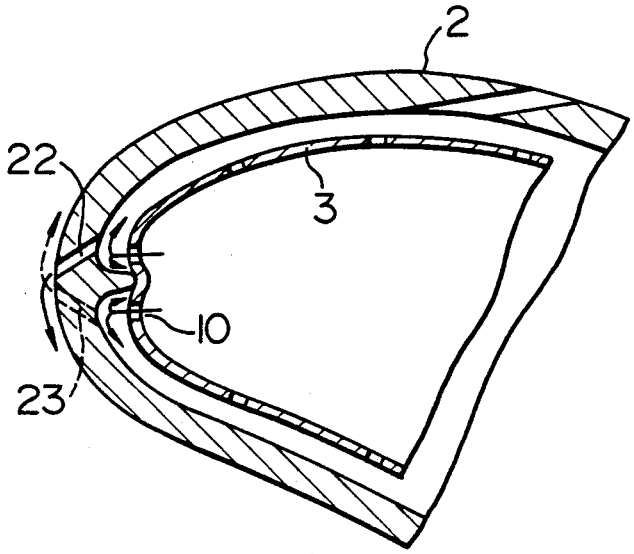
FIG. 7 is a cross-sectional partial view of a turbine blade, showing a further embodiment according to the present invention.
Figure 8:
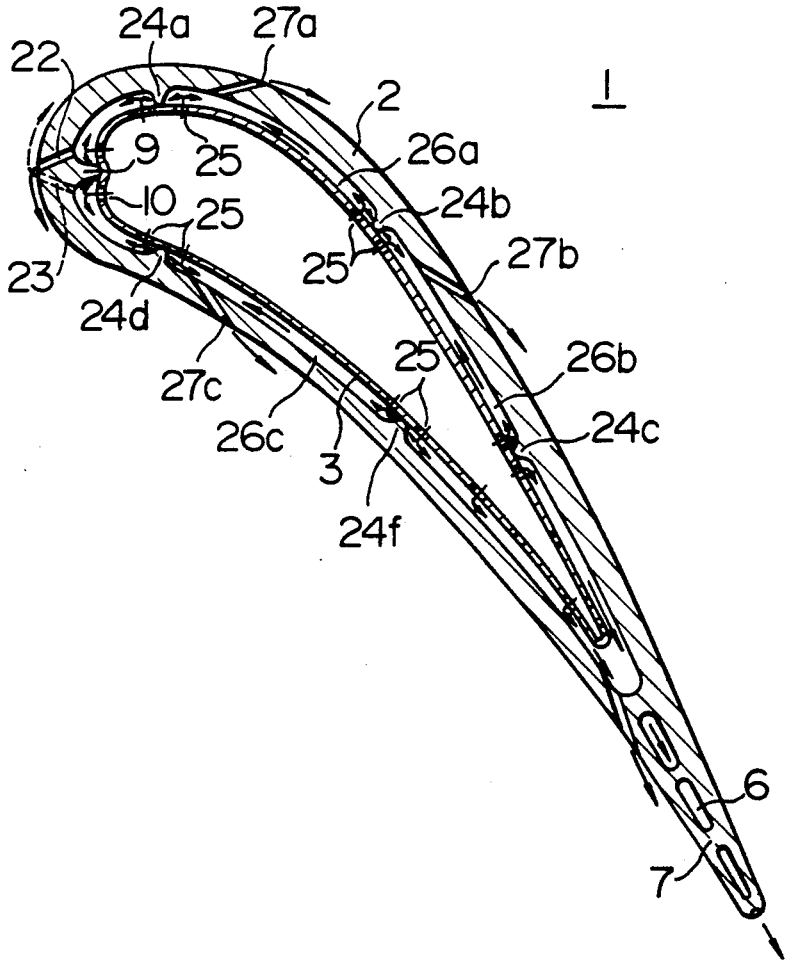
FIG. 8 is a cross-sectional view of a turbine blade, showing a still other embodiment according to the present invention.

FIG. 7 illustrates a cooling structure of a turbine blade in a gas turbine for higher temperature which includes film cooling arrangement in addition to the structure of the embodiment shown in FIG. 1. As shown in FIGS. 7 and 8, film cooling holes 22, 23 are bored through the leading edge of the blade body 2. The film cooling holes 22 on one side are inclined from one side of the spanwise finlike projection 9 toward the leading edge stagnation point, while the film cooling holes 23 on the other side are inclined from the other side of the spanwise finlike projection 9 toward the leading-edge stagnation point, and at the same time, the film cooling holes 22 and 23 are arranged so as not to occupy the same positions on a plane transverse to the spanwise direction, i.e., the film cooling holes 22 and 23 are alternately formed along the spanwise direction of the blade. The cooling air is discharged from the impingement holes 10 against the proximal portions of the spanwise finlike projection 9, and part of this cooling air is released from the leading edge film cooling holes 22 and 23 into the main working gas. In this application, the invention can thus provide the cooled blade which withstands the gas of higher temperature due to a high cooling effect of the inside of the blade and a thermal shield effect of the surface of the blade.

Further, FIG. 8 illustrates an application of the present invention where an entire turbine blade can be cooled. In FIG. 8, a plurality of spanwise finlike projections 24*a*, 24*b*, 24*c*. . . are formed on the suction side and pressure side inner surfaces of the blade body 2, and the edge of each of the spanwise finlike projections 24*a*, 24*b*, 24*c*. . . is in contact with the core plug 3. Impingement holes 25 are bored through the core plug 3 at such positions that the cooling air will be discharged against proximal portions of the spanwise finlike projections 24*a*, 24*b*, 24*c*. . . on both sides. Air cells 26*a*, 26*b*. . . are each defined by two of the spanwise finlike projections, the blade body 2 and the core plug 3. Film cooling holes 27*a*, 27*b*. . . are formed through the blade body 2 in order to eject the cooling are from the air cells therethrough and make it flow along the outer surface of the application, part of the cooling air is discharged against the proximal portions of the spanwise finlike projection 9 from the impingement holes 10, and ejected from the leading-edge film cooling holes 22 ad 23 so as to flow along the outer surface of the blade, thereby cooling the leading edge portion of the blade. At the same time, other part of the cooling air is discharged against the proximal portions of the spanwise finlike projections 24*a*, 24*b*, 24*c*. . . from the impingement holes 25, and ejected from the film cooling holes 27*a*, 27*b*. . . of the air cells 26*a*, 26*b*. . . so as to flow along the outer surface of the blade, thereby cooling the suction and pressure sides of the blade. Part of the impingement air is released along the outside of the blade from the slits 6 of the trailing edge of the blade, also cooling the trailing edge. In this application, the invention can provide the cooled turbine blade whose entire surface can be cooled with great efficiency, thus withstanding the gas of higher temperature.

It is more favorable that the film cooling holes 27*a*, 27*b*. . . are bored through the upstream sides of the air cells 26*a*, 26*b*. . . to even more effectively perform the thermal shield of the outer surfaces of the blade so that the film thermal shield effect can be principally produced over the outer surfaces of central portions of the air cells 26*a*, 26*b*. . . where the impingement cooling effect is given less effectively. The locations, number, and intervals of the spanwise finlike projections 24*a*, 24*b*, 24*c*. . . , the number and intervals of the impingement holes 25, the number and intervals of the film cooling holes 27*a*, 27*b*. . . and the like are suitably determined in accordance with the thermal condition of the main working gas so that the temperature of the blade will reach a target value.

Figure 9:
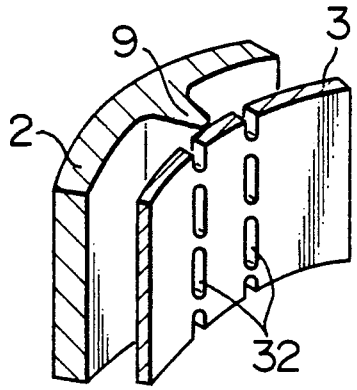
FIGS. 9 to 11 are perspective views of essential portions of a blade body and a core plug, showing modifications according to the present invention.
Figure 10:
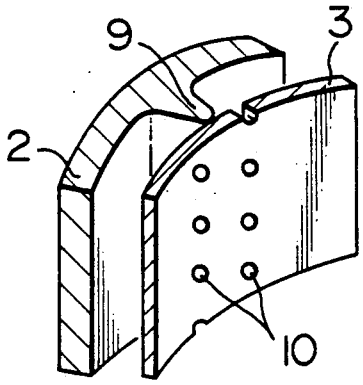
Figure 11:
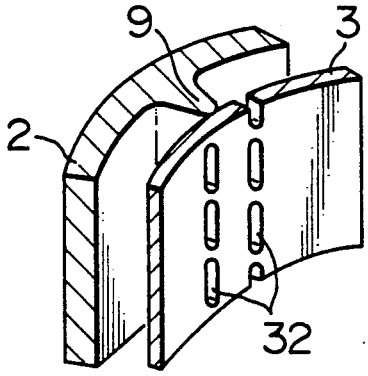

Next modifications of the present invention will be described with reference to FIGS. 9 to 11. Configurations and boring locations of impingement holes of the core plug 3 are shown in FIGS. 9 to 11, paying attention to the leading edge portion of the blade. FIG. 9 illustrates a structure where spanwise slot-like impingement holes 32 are located on both sides of the spanwise finlike projection 9. FIG. 10 illustrates a structure where the impingement holes 10 on both sides of the spanwise finlike projection 9 in the above-described embodiment shown in FIG. 1 are alternately located along the spanwise direction of the blade and deviated from one another. FIG. 11 illustrates a structure where the spanwise slot-like impingement holes 32 shown in FIG. 9 are alternately located along the spanwise direction of the blade and deviated from one another. It is a fundamental factor in any of these modification that the impingement cooling air is discharged against the proximal portions of the spanwise finlike projection 9 on both sides, and the cooling effect as high as that of the embodiments explained previously can be thus obtained.

As described hereinabove, according to the present invention, the projection extending along the spanwise direction of the blade is formed on the inner surface of the leading edge of the blade body so that the cooling medium discharged from the impingement holes of the core plug will impinge against the proximal portions of this projection. Since the discharged cooling medium does not stagnate in the inner passages near the leading edge of the blade where the temperature is the highest, i.e., since the discharged cooling medium from plural rows of impingement holes is separated by the spanwise projection and flows toward the ejection holes without mixing, thus the discharged cooling medium jets will not interfere with one another, and therefore, the leading edge of the blade which tends to have high temperature can be effectively cooled by a small amount of the cooling medium.

Alternatively, at least one projection or preferably a plurality of projections may be formed along the spanwise finlike projection on the inner surface of the blade body in the first embodiment according to the present invention. With this modified arrangement, the same effect can be also obtained.

What is claimed is:

1. A turbine blade comprising:

a hollow-structured main body, cooling medium discharging means located in an inner cavity of said hollow-structured main body for discharging a cooling medium from a surface thereof, cooling medium supplying means for supplying the cooling medium into the cooling medium discharging means so that the cooling medium discharged from the cooling medium discharging means impinges against the inner surface of the main body to remove heat therefrom, a projection formed on an inner surface of a leading edge of said main body and extending along the spanwise direction of the blade, wherein said cooling medium discharging means is formed to allow at least part of the cooling medium to directly impinge against opposite sides of proximal portions of the projection and the leading edge of the blade.

2. A turbine blade according to claim 1, wherein said turbine blade further includes at least one additional projection formed on the inner surface of said main body and extending along the spanwise direction of the blade, and wherein said cooling medium discharging means is formed to allow at least a portion of the cooling medium to directly impinge against opposite sides of proximal portions of the at least one additional projection.

3. A turbine blade comprising:

a hollow-structured main body, a core plug located in an inner cavity of the hollow-structured main body and having an outer surface spaced from an inner surface of the main body, impingement holes bored through side surfaces of said core plug, cooling medium supplying means for supplying a cooling medium into the inner cavity of the core plug so that the cooling medium supplied into the core plug is discharged from the impingement holes and impinges against the inner surface of the main body to cool the main body, a projection formed on the inner surface of a leading edge of said main body and extending in the spanwise direction of the blade, wherein said impingement holes are located to allow the cooling medium discharged from at least some of the impingement holes to directly impinge against opposite sides of proximal portions of the projection and the leading edge of the blade.

4. A turbine blade according to claim 3, wherein said impingement holes are located at certain intervals along the spanwise direction of the blade.

5. A turbine blade according to claim 3, wherein said at least some of the impingement holes are arranged in a plurality of rows respectively opposite to the proximal portions of said projection on both sides.

6. A turbine blade according to claim 5, wherein said at least some of the impingement holes are slots.

7. A turbine blade according to claim 5, wherein said at least some of the impingement holes in said rows are alternately located along the spanwise direction of the blade and displaced with respect to one another.

8. A turbine blade according to claim 7, wherein said at least some of the impingement holes are slots.

9. A turbine blade comprising:

a hollow-structured main body, cooling medium discharging means located in an inner cavity of the hollow-structured main body and formed with impingement holes through which a medium is discharged form the surface thereof, cooling medium supplying means for supplying the cooling medium into the cooling medium discharging means so that the cooling medium discharged from the cooling medium discharging means impinges against an inner surface of the main body to remove heat therefrom, a projection formed on an inner surface of the leading edge of said main body and extending along the spanwise direction of the blade, wherein said cooling medium discharged from at least some of the impingement holes to directly impinge against proximal portions of the projection on both sides thereby arranging jets of the cooling medium after the impingement to be ejected out of the main body without being mixed with one another.

10. A turbine blade according to claim 9, wherein said turbine blade further includes at least one additional projection which is formed on the inner surface of said main body, extending along the spanwise direction of the blade, said cooling medium discharging means being formed to allow the cooling medium discharged from at least some of the impingement holes to directly impinge against proximal portions of the additional projection thereby arranging jets of the cooling medium after the impingement to be drained out of the main body without being mixed with one another.

11. A turbine blade comprising:

a hollow-structured main body to be cooled from an inner surface thereof, cooling medium discharging means located in an inner cavity of the hollow-structured main body for discharging a cooling medium from the surface thereof, cooling medium supplying means for supplying the cooling medium into the cooling medium discharging means so that the cooling medium discharged from the cooling medium discharging means impinges against an inner surface of the main body to remove the heat therefrom, at least one laterally extending projection formed on the inner surface of the leading edge of said main body and wherein said cooling medium discharging means is formed to allow at least some of the cooling medium discharged from said cooling medium discharging means to directly impinge against opposite sides of proximal portions of the at least one laterally extending projection.

12. A turbine blade comprising:

a hollow-structured main body, a core plug located in an inner cavity of the hollow-structured main body and having an outer surface spaced from an inner surface of the main body and formed to discharge a cooling medium from the surface thereof, cooling medium supplying means for supplying the cooling medium into the core plug so that the cooling medium discharged from the core plug impinges against an inner surface of the main body to cool the main body, a projection formed on an inner surface of a leading edge of said main body and extending along a spanwise direction of the blade, wherein an edge of the projection is in close contact with the surface of said core plug, and wherein said core plug is formed to allow at least part of the cooling medium discharged from the core plug to impinge against opposite sides of a proximal portion of the projection.

13. A turbine blade according to claim 12, further comprising a groove formed in a surface of said core plug at a position where the core plug confronts the edge of said projection so that an edge of the projection is in close contact with the groove.

* * * * *